US008636102B1

(12) United States Patent
Porco

(10) Patent No.: US 8,636,102 B1
(45) Date of Patent: Jan. 28, 2014

(54) VOICE AMPLIFICATION ASSEMBLY

(71) Applicant: Tony Porco, Steubenville, OH (US)

(72) Inventor: Tony Porco, Steubenville, OH (US)

( * ) Notice: Subject to any disclaimer, the term of this patent is extended or adjusted under 35 U.S.C. 154(b) by 0 days.

(21) Appl. No.: 13/653,760

(22) Filed: Oct. 17, 2012

(51) Int. Cl.
*G10K 11/00* (2006.01)

(52) U.S. Cl.
USPC ..... 181/178

(58) Field of Classification Search
USPC ..... 181/178
See application file for complete search history.

(56) References Cited

U.S. PATENT DOCUMENTS

| | | | | | |
|---|---|---|---|---|---|
| 773,344 | A | * | 10/1904 | Sanderson | 181/178 |
| 936,910 | A | | 10/1909 | Kingsley | |
| 951,757 | A | * | 3/1910 | Dyer | 369/81 |
| 1,069,642 | A | * | 8/1913 | Houlston | 181/178 |
| 1,095,747 | A | * | 5/1914 | Stanislao | 369/81 |
| 1,504,170 | A | | 8/1924 | Weins | |
| 1,516,754 | A | * | 11/1924 | Schluesselburg | 181/178 |
| 1,541,122 | A | | 6/1925 | Dodge et al. | |
| 2,517,665 | A | | 8/1950 | Hochstein | |
| 2,790,504 | A | * | 4/1957 | Hooe | 181/178 |
| 4,703,829 | A | | 11/1987 | Hardt | |
| 5,082,084 | A | * | 1/1992 | Ye-Ming | 181/153 |
| D559,830 | S | | 1/2008 | Lintern | |

* cited by examiner

*Primary Examiner* — Forrest M Phillips

(57) ABSTRACT

A voice amplification assembly includes a plurality of rings movably coupled to one another so said rings may form a megaphone.

5 Claims, 3 Drawing Sheets

VOICE AMPLIFICATION ASSEMBLY

BACKGROUND OF THE DISCLOSURE

Field of the Disclosure

The disclosure relates to voice amplification devices and more particularly pertains to a new voice amplification device for amplifying a user's voice.

SUMMARY OF THE DISCLOSURE

An embodiment of the disclosure meets the needs presented above by generally comprising a plurality of rings movably coupled to one another so said rings may form a megaphone.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
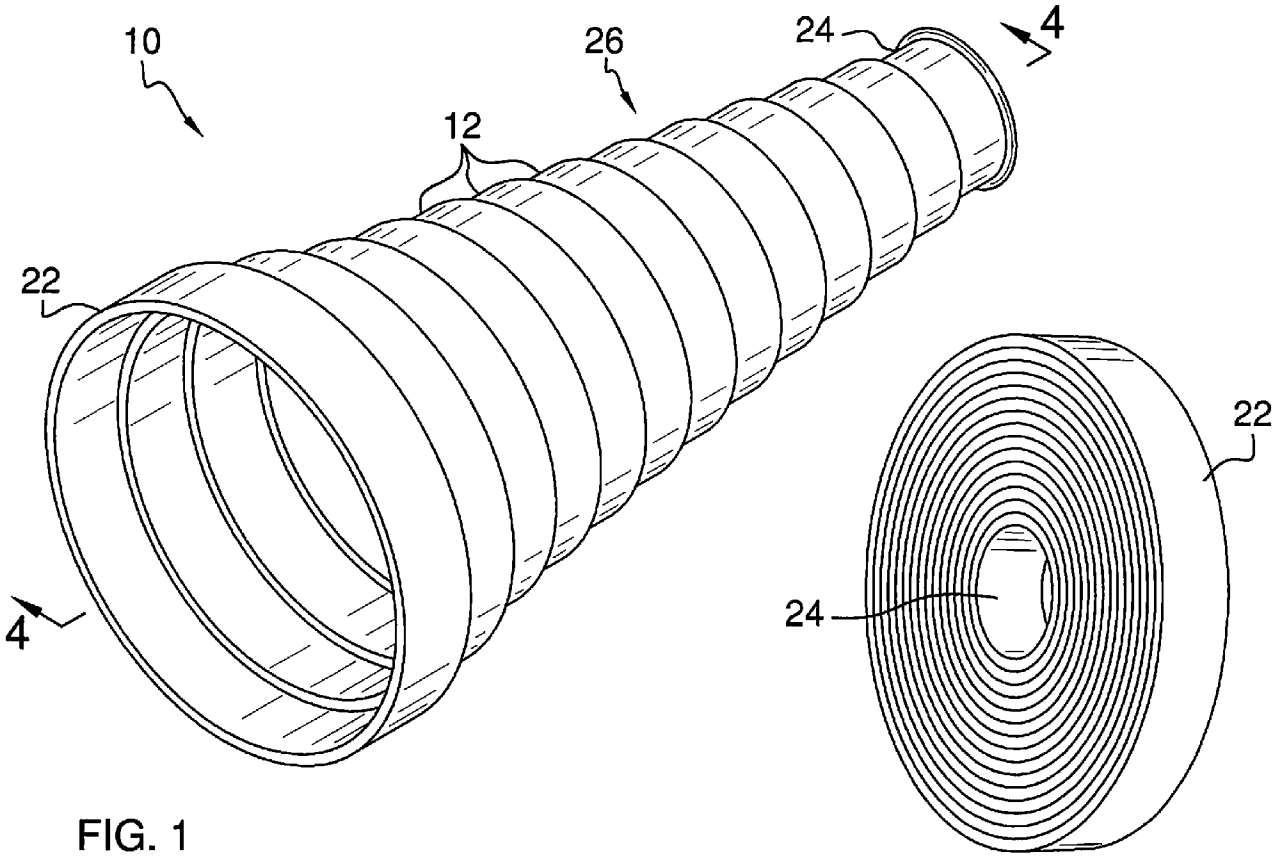
FIG. 1 is a perspective view of a voice amplification assembly according to an embodiment of the disclosure.
FIG. 2 is a side perspective view of an embodiment of the disclosure.
Figure 3:
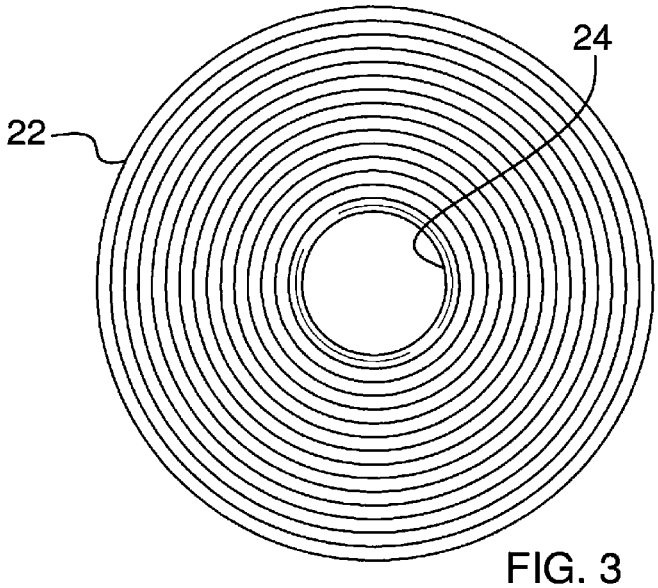
FIG. 3 is a front view of an embodiment of the disclosure.
Figure 4:
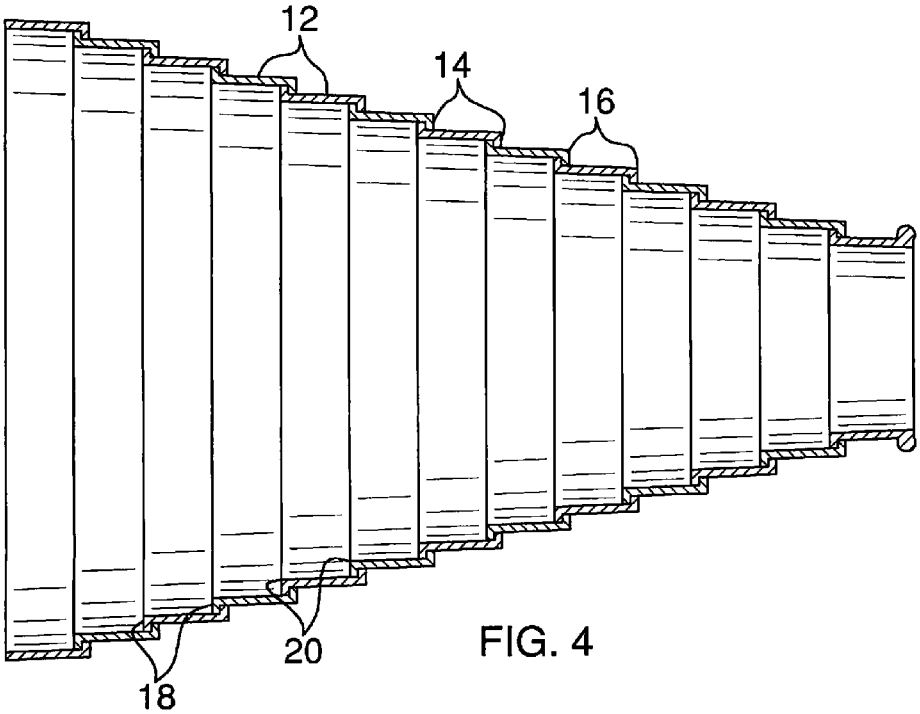
FIG. 4 is a cross sectional view taken along line 4-4 of FIG. 1 of an embodiment of the disclosure.
Figure 5:
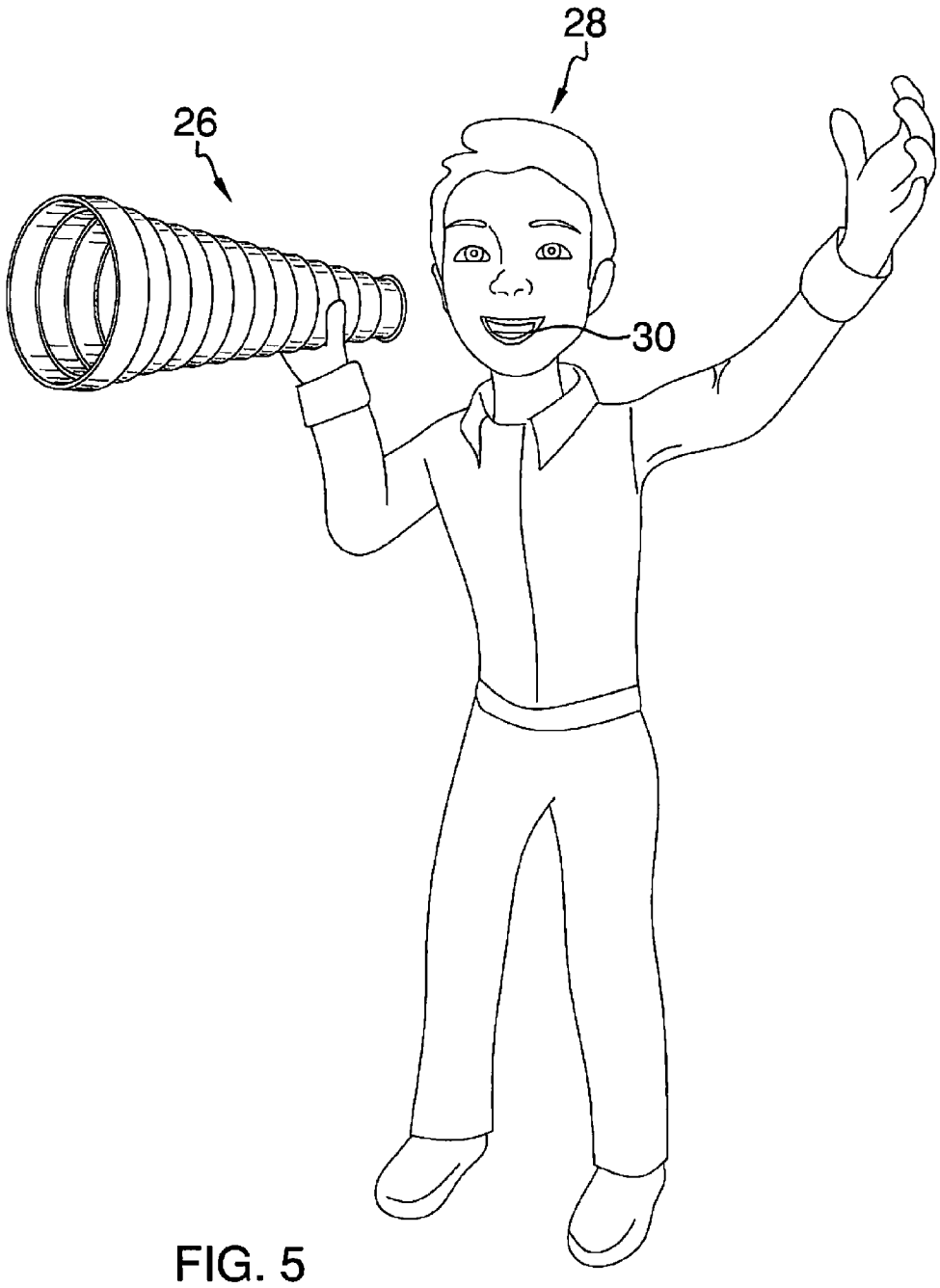
FIG. 5 is an in-use view of an embodiment of the disclosure.

With reference now to the drawings, and in particular to FIGS. 1 through 5 thereof, a new voice amplification device embodying the principles and concepts of an embodiment of the disclosure and generally designated by the reference numeral 10 will be described.

As best illustrated in FIGS. 1 through 5, the voice amplification assembly 10 generally comprises a plurality of rings 12 each having a diameter that is greater than or less than an adjacent ring 12 so the rings 12 are telescopically positionable. Each of the plurality of rings 12 has a sequentially increasing diameter ranging between a minimum diameter between 2.5 cm and 5 cm and a maximum diameter between 16.5 cm and 19 cm. A rear lip 14 is coupled to and extends inwardly from a rear side 16 of each of the plurality of rings 12. A front lip 18 is coupled to and extends outwardly from a front side 20 of each of the plurality of rings 12.

The plurality of rings 12 is positionable in an extended position so the front lip 18 on each of the plurality of rings 12 abuts the rear lip 14 of the associated adjacent ring 12. The rear lip 14 on each of the rings 12 abuts the front lip 18 of the associated adjacent ring 12. In the extended position a largest one of the rings 22 is positioned a maximum distance away from a smallest one of the rings 24 so the plurality of rings 12 form a megaphone 26.

The smallest ring 24 may be positioned proximate a user's 28 mouth 30 when the plurality of rings 12 is positioned in the extended position so the user 28 may speak into the smallest ring 24. The megaphone 26 may amplify the user's 28 voice. The plurality of rings 12 is positionable in a retracted position that has each of the plurality of the rings 12 positioned within the largest ring 22. The front lips 18 of each of the plurality of rings 12 are adjacent to one another when the rings 12 are positioned in the retracted position.

In use, the assembly 10 allows for a method of amplifying the user's 28 voice. The steps of the method comprise a step of providing the plurality of telescopically positionable rings 12, the rear lip 14 coupled to the rear side 16 of each of the rings 12 and the front lip 18 coupled to the front side 20 of each of the rings 12. The method includes a step of positioning the plurality of rings 12 in the extended position.

Additionally, the method includes a step of positioning the smallest ring 24 proximate the user's 28 mouth 30. The method further includes a step of speaking into the smallest ring 24 so the plurality of rings 12 amplifies the user's 28 voice. Finally, the method includes a step of positioning the plurality of rings 12 in the retracted position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A voice amplification assembly comprising:

a plurality of rings movably coupled to one another wherein said rings are configured to form a megaphone;

a rear lip coupled to and extending inwardly from a rear side of each of said plurality of rings;

a front lip coupled to and extending outwardly from a front side of each of said plurality of rings;

said plurality of rings being concentric and positionable in an extended position wherein said front lip on each of said plurality of rings abuts said rear lip of the associated adjacent ring and said rear lip on each of said rings abuts said front lip of the associated adjacent ring, wherein a largest one of said rings is positioned a maximum distance away from a smallest one of said rings; and each of said rings extending from said smallest one of said rings defining an unobstructed exterior surface parallel to an adjacently positioned said ring wherein each of said rings extending from said smallest one of said rings is selectively disengageable from an adjacently positioned one of said rings extending from said smallest one of said rings.

2. The assembly according to claim 1, further comprising said plurality of rings each having a diameter being greater than or less than an adjacent ring wherein said plurality of rings are telescopically positionable.

3. The assembly according to claim 1, further comprising said smallest ring being positionable proximate a user's mouth when said plurality of rings is positioned in said extended position wherein the user may speak into said smallest ring wherein said plurality of rings amplifies the user's voice.

4. The assembly according to claim 2, further comprising said plurality of rings being positionable in a retracted position having each of said plurality of said rings positioned within said largest ring such that a forward lip of each of said plurality of rings is adjacent to one another.

5. A voice amplification assembly comprising:

a plurality of rings each having a diameter being greater than or less than an adjacent ring wherein said rings are telescopically positionable;

a rear lip coupled to and extending inwardly from a rear side of each of said plurality of rings;

a front lip coupled to and extending outwardly from a front side of each of said plurality of rings;

said plurality of rings being positionable in an extended position wherein said front lip on each of said plurality of rings abuts said rear lip of the associated adjacent ring and said rear lip on each of said rings abuts said front lip of the associated adjacent ring, wherein a largest one of said rings is positioned a maximum distance away from a smallest one of said rings, said smallest ring being positionable proximate a user's mouth when said plurality of rings is positioned in said extended position wherein the user may speak into said smallest ring wherein said plurality of rings amplifies the user's voice, said plurality of rings being positionable in a retracted position having each of said plurality of said rings positioned within said largest ring such that said forward lips of each of said plurality of rings are adjacent to one another; and each of said rings extending from said smallest one of said rings defining an unobstructed exterior surface parallel to an adjacently positioned said ring wherein each of said rings extending from said smallest one of said rings is selectively disengageable from an adjacently positioned one of said rings extending from said smallest one of said rings.

* * * * *